US007075560B2

(12) United States Patent
Ohe et al.

(10) Patent No.: US 7,075,560 B2
(45) Date of Patent: Jul. 11, 2006

(54) DISPLAY APPARATUS THAT CAN CONTROL POWER WHILE RETAINING GRAYSCALE CONTINUITY, AND METHOD FOR DRIVING THE SAME

(75) Inventors: Takayuki Ohe, Kawasaki (JP); Toshio Ueda, Kawasaki (JP); Akira Yamamoto, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 395 days.

(21) Appl. No.: 10/274,991

(22) Filed: Oct. 22, 2002

(65) Prior Publication Data

US 2003/0174150 A1 Sep. 18, 2003

(30) Foreign Application Priority Data

Mar. 15, 2002 (JP) ..... 2002-072861

(51) Int. Cl.
*G09G 5/10* (2006.01)

(52) U.S. Cl. ..... 345/690; 345/211; 315/169.1; 315/169.3; 315/169.4

(58) Field of Classification Search ..... 345/60, 345/63, 211, 214, 690, 692, 698; 315/169.1–169.4
See application file for complete search history.

(56) References Cited

U.S. PATENT DOCUMENTS 5,818,419 A * 10/1998 Tajima et al. ..... 345/691
5,943,032 A 8/1999 Nagaoka et al.
6,069,609 A 5/2000 Ishida et al.
6,104,362 A * 8/2000 Kuriyama et al. ..... 345/63
6,448,960 B1 * 9/2002 Shigeta ..... 345/204
6,476,824 B1 * 11/2002 Suzuki et al. ..... 345/690
6,646,625 B1 * 11/2003 Shigeta et al. ..... 345/63
6,768,477 B1 * 7/2004 Beuker et al. ..... 345/55

FOREIGN PATENT DOCUMENTS

| | | |
|---|---|---|
| EP | 0 653 740 | 5/1995 |
| EP | 0 707 302 | 4/1996 |
| EP | 0 720 139 | 7/1996 |
| JP | 6-332397 | 12/1994 |
| JP | 8-179724 | 7/1996 |
| JP | 2000-98970 | 4/2000 |
| WO | WO 99/30308 | 6/1999 |
| WO | WO 99/30310 | 6/1999 |

OTHER PUBLICATIONS

European Search Report dated Dec. 29, 2005 for related European Patent Application No. 02257440.4-2205.

* cited by examiner

*Primary Examiner*—Henry N. Tran
(74) *Attorney, Agent, or Firm*—Staas & Halsey LLP

(57) ABSTRACT

A method for driving a display apparatus has a predetermined plural number of light emission blocks in each field, and displays grayscale by combining the light emission blocks. A grayscale level addition/subtraction operation is performed, by computation, on a discontinuous grayscale in accordance with an input grayscale level or the grayscale level addition/subtraction operation is performed, on a discontinuous grayscale, in accordance with an input grayscale level, before applying error diffusion, for any brightness discontinuous portion occurring due to the combination of the light emission blocks.

9 Claims, 16 Drawing Sheets

Fig.3
| | SF0 | SF1 | SF2 | SF3 | SF4 | SF5 | SF6 |
|---|---|---|---|---|---|---|---|
| WEIGHT | 1 | 2 | 4 | 8 | 16 | 32 | 64 |
| NUMBER OF SUSs | 4 | 8 | 16 | 32 | 64 | 128 | 256 |
Fig.4A
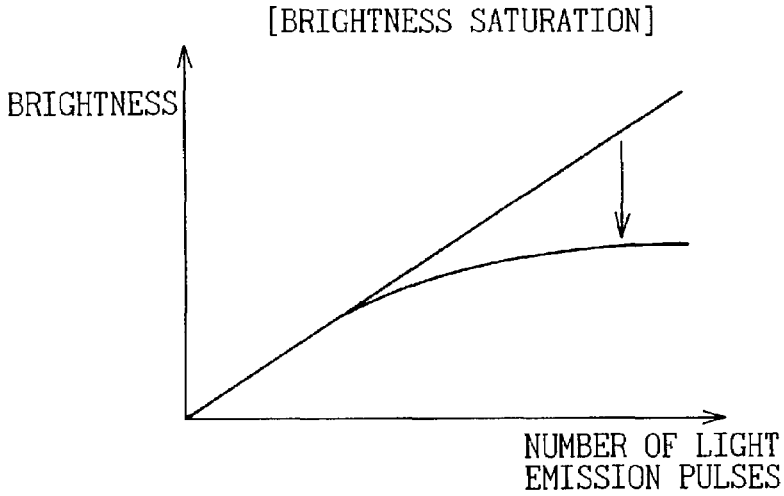
Fig.4B
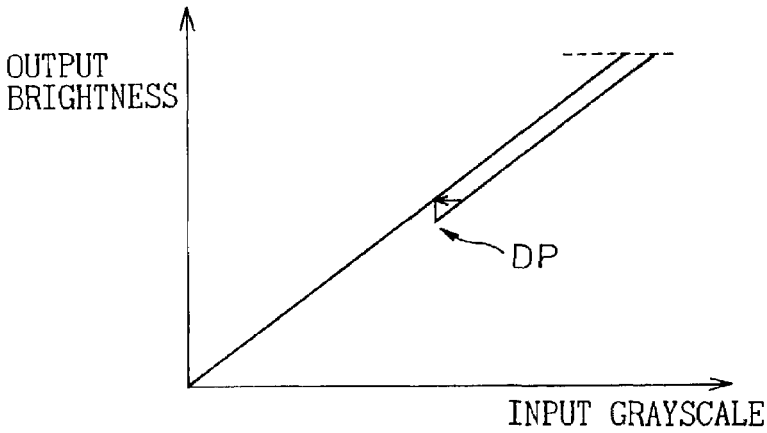

Fig.7

| INPUT GRAYSCALE LEVEL | 1 | 2 | 3 | 4 | 5 | 6 | 7 | 8 |
|---|---|---|---|---|---|---|---|---|
| THEORETICAL VALUE | 4 | 8 | 12 | 16 | 20 | 24 | 28 | 32 |
| GRAYSCALE BY CALCULATION | 1 | 2 | 3 | 4 | 5 | 6 | 7 | 8 |
| BRIGHTNESS | 4 | 8 | 6 | 10 | 14 | 18 | 22 | 26 |
| GRAYSCALE BY CALCULATION | 1 | 2 | 5 | 6 | 7 | 8 | 9 | 10 |
| BRIGHTNESS | 4 | 8 | 14 | 18 | 22 | 26 | 30 | 34 |
| CONTROL | | | ADDITION "+2" | | | | | |

WITHOUT COMPUTATION

WITHOUT COMPUTATION

WITH COMPUTATION

Fig.11

$$
\begin{aligned}
DO[9:0] = DI[9:0] &+ \{X0[3:0] \times Z0(Y0[7:0], DI[9:2])\} \\
&+ \{X1[3:0] \times Z1(Y1[7:0], DI[9:2])\} \\
&+ \{X2[3:0] \times Z2(Y2[7:0], DI[9:2])\} \\
&+ \{X3[3:0] \times Z3(Y3[7:0], DI[9:2])\} \\
&+ \{X4[3:0] \times Z4(Y4[7:0], DI[9:2])\} \\
&+ \{X5[3:0] \times Z5(Y5[7:0], DI[9:2])\} \\
&+ \{X6[3:0] \times Z6(Y6[7:0], DI[9:2])\} \\
&+ \{X7[3:0] \times Z7(Y7[7:0], DI[9:2])\} \\
&+ \{X8[3:0] \times Z8(Y8[7:0], DI[9:2])\} \\
&+ \{X9[3:0] \times Z9(Y9[7:0], DI[9:2])\} \\
&+ \{X10[3:0] \times Z10(Y10[7:0], DI[9:2])\} \\
&+ \{X11[3:0] \times Z11(Y11[7:0], DI[9:2])\} \\
&+ \{X12[3:0] \times Z12(Y12[7:0], DI[9:2])\} \\
&+ \{X13[3:0] \times Z13(Y13[7:0], DI[9:2])\} \\
&+ \{X14[3:0] \times Z14(Y14[7:0], DI[9:2])\} \\
&+ \{X15[3:0] \times Z15(Y15[7:0], DI[9:2])\}
\end{aligned}
$$

Fig.13

| INPUT GRAYSCALE LEVEL | 1 | 2 | 3 | 4 | 5 | 6 | 7 | 8 |
|---|---|---|---|---|---|---|---|---|
| THEORETICAL VALUE | 4 | 8 | 12 | 16 | 20 | 24 | 28 | 32 |
| GRAYSCALE BY CALCULATION | 1 | 2 | 3 | 4 | 5 | 6 | 7 | 8 |
| BRIGHTNESS | 4 | 8 | 6 | 10 | 14 | 18 | 22 | 26 |
| GRAYSCALE BY CALCULATION | 1 | 2 | 4.5 | 5.5 | 6.5 | 7.5 | 8.5 | 9.5 |
| BRIGHTNESS | 4 | 8 | 12 | 16 | 20 | 24 | 28 | 32 |
| CONTROL | | | ADDITION "1.5" | | | | | |

WITHOUT COMPUTATION

WITH COMPUTATION

WITHOUT COMPUTATION

Fig.14

| ITEM | SF NUMBER | SF 0 | SF 1 | SF 2 | SF 3 | SF 4 | SF 5 | SF 6 |
|---|---|---|---|---|---|---|---|---|
| | SF WEIGHT | 1 | 2 | 4 | 8 | 16 | 32 | 64 |
| | IDEAL BRIGHTNESS | 2 | 4 | 8 | 16 | 32 | 64 | 128 |
| 1 | TOTAL NUMBER OF SUSs: 254 (IDEAL VALUE) | 2 | 4 | 8 | 16 | 32 | 64 | 128 |
| 2 | TOTAL NUMBER OF SUSs: 200 | 2 | 3 | 6 | 13 | 25 | 50 | 101 |
| 3 | METHOD OF PRESENT INVENTION | 2 | 4 | 8 | 12 | 25 | 50 | 99 |
| 4 | DETAILS OF PROCESSING | FIX NUMBER OF SUSs | | | REDUCE NUMBER OF SUSs TO REDUCE POWER | | | |

Fig.15

| ITEM | SF NUMBER | SF 0 | SF 1 | SF 2 | SF 3 | SF 4 | SF 5 | SF 6 |
|---|---|---|---|---|---|---|---|---|
| | SF WEIGHT | 1 | 2 | 4 | 8 | 16 | 32 | 64 |
| | IDEAL BRIGHTNESS RATIO | 1 | 2 | 4 | 8 | 16 | 32 | 64 |
| 1 | TOTAL NUMBER OF SUSs: 127 (IDEAL VALUE 1) | 1 | 2 | 4 | 8 | 16 | 32 | 64 |
| 2 | TOTAL NUMBER OF SUSs: 254 (IDEAL VALUE 2) | 2 | 4 | 8 | 16 | 32 | 64 | 128 |
| 3 | TOTAL NUMBER OF SUSs: 381 (IDEAL VALUE 3) | 3 | 6 | 12 | 24 | 48 | 96 | 192 |
| 4 | TOTAL NUMBER OF SUSs: 508 (IDEAL VALUE 4) | 4 | 8 | 16 | 32 | 64 | 128 | 256 |

DISPLAY APPARATUS THAT CAN CONTROL POWER WHILE RETAINING GRAYSCALE CONTINUITY, AND METHOD FOR DRIVING THE SAME

FIELD OF THE INVENTION

The present invention relates to a display apparatus and a method for driving the same and, more particularly to a display apparatus, such as a plasma display panel (PDP), that has, in each field, a plurality of light emission blocks each comprising a plurality of light emission pulses, and that displays a grayscale by combining these light emission blocks, and a method for driving such a display apparatus.

DESCRIPTION OF THE RELATED ART

With the recent trend toward larger-screen displays, the need for thin display apparatuses has been increasing, and various types of thin display apparatus have been commercially implemented. Examples include matrix panels that display images by directly using digital signals, such as PDPs and other gas discharge display panels, digital micromirror devices (DMDs), EL display devices, fluorescent display tubes, and liquid crystal display devices. Among such thin display devices, gas discharge display panels are considered to be the most promising candidate for large-area, direct-view HDTV (high-definition television) display devices, because of the simple production process which facilitates fabrication of larger-area displays, the self-luminescent property which ensures good display quality, and the high response speed.

For example, in a PDP, one field is divided into a plurality of light emission blocks (subfields: SFs) each comprising a plurality of light emission pulses, and a grayscale is displayed by combining these light emission blocks. The power consumed by the light emission of the PDP is approximately proportional to the number of light emission pulses (sustain pulses) applied to sustain the light emission, and the power consumption of the PDP can be controlled by controlling the total number of light emission pulses in each field. The number of light emission pulses must be controlled without causing image degradation but, when a specified number of light emission pulses is assigned to each individual subfield, a grayscale discontinuity may occur depending on the total number of light emission pulses. In view of this, in the case of a display apparatus for displaying a grayscale by combining light emission blocks, it is desired to provide a display apparatus that can control the power consumed by light emission while retaining continuity of light emission by performing control so that the brightness varies smoothly over a discontinuous grayscale portion (stepped portion), and also provide a method for driving such a display apparatus.

In this specification, the term "field" is used by assuming the case of interlaced scanning in which one image frame is made up of two fields, an odd field and an even field, but in the case of progressive scanning in which one image frame is made up of one field, the term "field" can be used interchangeably with "frame".

In the prior art, light emission pulses are set, for example, by calculating a display load ratio for each frame from display data and by performing computation based on the display load ratio for each frame (field) so that the power consumption of the display apparatus will not exceed a predetermined value. Such techniques are disclosed, for example, in Japanese Unexamined Patent Publication (Kokai) Nos. 06-332397 and 2000-098970.

More specifically, Japanese Unexamined Patent Publication (Kokai) No. 06-332397 discloses a flat panel display apparatus comprising an integrating means for integrating the number of pixel signals of a prescribed level applied during a prescribed period, and a frequency changing means for changing the panel driving frequency based on the result of the integration of the integrating means, while Japanese Unexamined Patent Publication No. 2000-098970 discloses a plasma display apparatus comprising an integrating means for integrating, for each bit signal used to achieve grayscale display, the number of pixel signals applied during a prescribed period, and a frequency changing means for changing the frequency of a sustain discharge waveform, based on the result of the integration of the integrating means.

The prior art, the related art, and their associated problems will be described in detail later with reference to accompanying drawings.

SUMMARY OF THE INVENTION

An object of the present invention is to provide a display apparatus that can control power while retaining grayscale continuity, and a method for driving such a display apparatus.

According to the present invention, there is provided a method for driving a display apparatus that has a predetermined plural number of light emission blocks in each field, and that displays a grayscale by combining the light emission blocks wherein, for any brightness discontinuous portion occurring due to the combination of the light emission blocks, a grayscale level addition/subtraction operation is performed by computation on the discontinuous grayscale in accordance with an input grayscale level.

Further, according to the present invention, there is provided a method for driving a display apparatus that has a predetermined plural number of light emission blocks in each field, and that displays a grayscale by combining the light emission blocks, wherein for any brightness discontinuous portion occurring due to the combination of the light emission blocks, a grayscale level addition/subtraction operation is performed on the discontinuous grayscale in accordance with an input grayscale level before applying error diffusion.

According to the present invention, there is also provided a method for driving a display apparatus that has in each field a predetermined plural number of light emission blocks each comprising a plurality of light emission pulses, and that displays grayscale by combining the light emission blocks wherein, when adjusting the number of light emission pulses for power control, the number of light emission pulses is determined for each of the plurality of light emission blocks while holding unchanged the number of light emission pulses for each light emission block that has a relatively small number of light emission pulses.

A plurality of ideal values may be set for the combination of the light emission blocks by using as a reference the brightness of the light emission block having the smallest weight and, of the plurality of ideal values, the ideal value whose total number of light emission pulses is larger than, and closest to, the total number of light emission pulses determined by power control is selected as a reference. A plurality of ideal values may be set for the combination of the light emission blocks by using as a reference the brightness of the light emission block having the smallest weight and, of the plurality of ideal values, the ideal value whose total number of light emission pulses is closest to the total number of light emission pulses determined by power control is selected as a reference.

For any discontinuous grayscale of brightness occurring as a result of the adjustment of the number of light emission pulses, a grayscale level addition/subtraction operation may be performed by computation in accordance with a display ratio. For any discontinuous grayscale of brightness occurring as a result of the adjustment of the number of light emission pulses, a grayscale level addition/subtraction operation may be performed in accordance with a display ratio before applying error diffusion.

According to the present invention, there is provided a display apparatus that has a predetermined plural number of light emission blocks in each field, and that displays grayscale by combining the light emission blocks, comprising an addition/subtraction determining section which receives an image signal, and determines whether an addition or subtraction operation is to be applied to a brightness discontinuous portion occurring due to the combination of the light emission blocks; and an addition/subtraction operation section which, based on an output of the addition/subtraction determining section, performs for the brightness discontinuous portion a grayscale level addition or subtraction operation by computation on discontinuous grayscale in accordance with an input grayscale level.

Further, according to the present invention, there is provided a display apparatus that has a predetermined plural number of light emission blocks in each field, and that displays grayscale by combining the light emission blocks, comprising an addition/subtraction determining section which receives an image signal, and determines whether an addition or subtraction operation is to be applied to a brightness discontinuous portion occurring due to the combination of the light emission blocks; an error diffusion processing section for applying error diffusion to the image signal; and an addition/subtraction operation section which precedes the error diffusion processing section, and which, based on an output of the addition/subtraction determining section, performs for the brightness discontinuous portion a grayscale level addition or subtraction operation on discontinuous grayscale in accordance with an input grayscale level.

According to the present invention, there is also provided a display apparatus comprising a display panel section; a data converter which receives an image signal and supplies image data suitable for the display apparatus to the display panel section, while at the same time, outputting a display load ratio by computing the same from the image signal; a power supply section which supplies power to the display panel section and, at the same time, outputs information concerning the power being consumed by the display panel section; and a number-of-light-emission-pulses control circuit which receives the display load ratio and the power consumption information and, when adjusting the number of light emission pulses to control the power, determines the number of light emission pulses for each of the plurality of light emission blocks while holding unchanged the number of light emission pulses for each light emission block that has a relatively small number of light emission pulses.

The number-of-light-emission-pulses control circuit may set a plurality of ideal values for the combination of the light emission blocks by using, as a reference, the brightness of the light emission block having the smallest weight and, from among the plurality of ideal values, may select as a reference the ideal value whose total number of light emission pulses is larger than and closest to the total number of light emission pulses determined by power control. The number-of-light-emission-pulses control circuit may set a plurality of ideal values for the combination of the light emission blocks by using as a reference the brightness of the light emission block having the smallest weight and, from among the plurality of ideal values, may select as a reference the ideal value whose total number of light emission pulses is closest to the total number of light emission pulses determined by power control.

The display apparatus may further comprise a grayscale continuity compensating circuit which compensates grayscale continuity by performing a grayscale level addition/subtraction operation by computation in accordance with a display ratio for any discontinuous grayscale of brightness occurring as a result of the adjustment of the number of light emission pulses. The display apparatus may further comprise an error diffusion processing section which applies error diffusion to the image signal; and a grayscale continuity compensating circuit which precedes the error diffusion processing section, and which compensates for grayscale continuity by performing a grayscale level addition/subtraction operation in accordance with a display ratio for any discontinuous grayscale of brightness occurring as a result of the adjustment of the number of light emission pulses.

BRIEF DESCRIPTION OF THE DRAWINGS

The present invention will be more clearly understood from the description of the preferred embodiments as set forth below with reference to the accompanying drawings, wherein:

FIG. 3 is a diagram showing how the total number of light emission pulses is divided in accordance with a weight ratio among subfields;

FIGS. 4A and 4B are diagrams for explaining the problem associated with a prior art display apparatus driving method;

FIG. 7 is a diagram for explaining the problem associated with the display apparatus driving method according to the related art;

FIG. 11 is a diagram for explaining one example of the operation of the grayscale continuity compensating circuit shown in FIG. 9;

FIG. 13 is a diagram for explaining a first embodiment of the display apparatus driving method according to the present invention;

FIG. 14 is a diagram for explaining a second embodiment of the display apparatus driving method according to the present invention;

FIG. 15 is a diagram for explaining a third embodiment of the display apparatus driving method according to the present invention;

DESCRIPTION OF THE PREFERRED EMBODIMENTS

Before proceeding to the detailed description of the preferred embodiments of a display apparatus and its driving method according to the present invention, a display apparatus and its driving method according to the prior art and the related art and their problems will be described, with reference to drawings.

Figure 1:
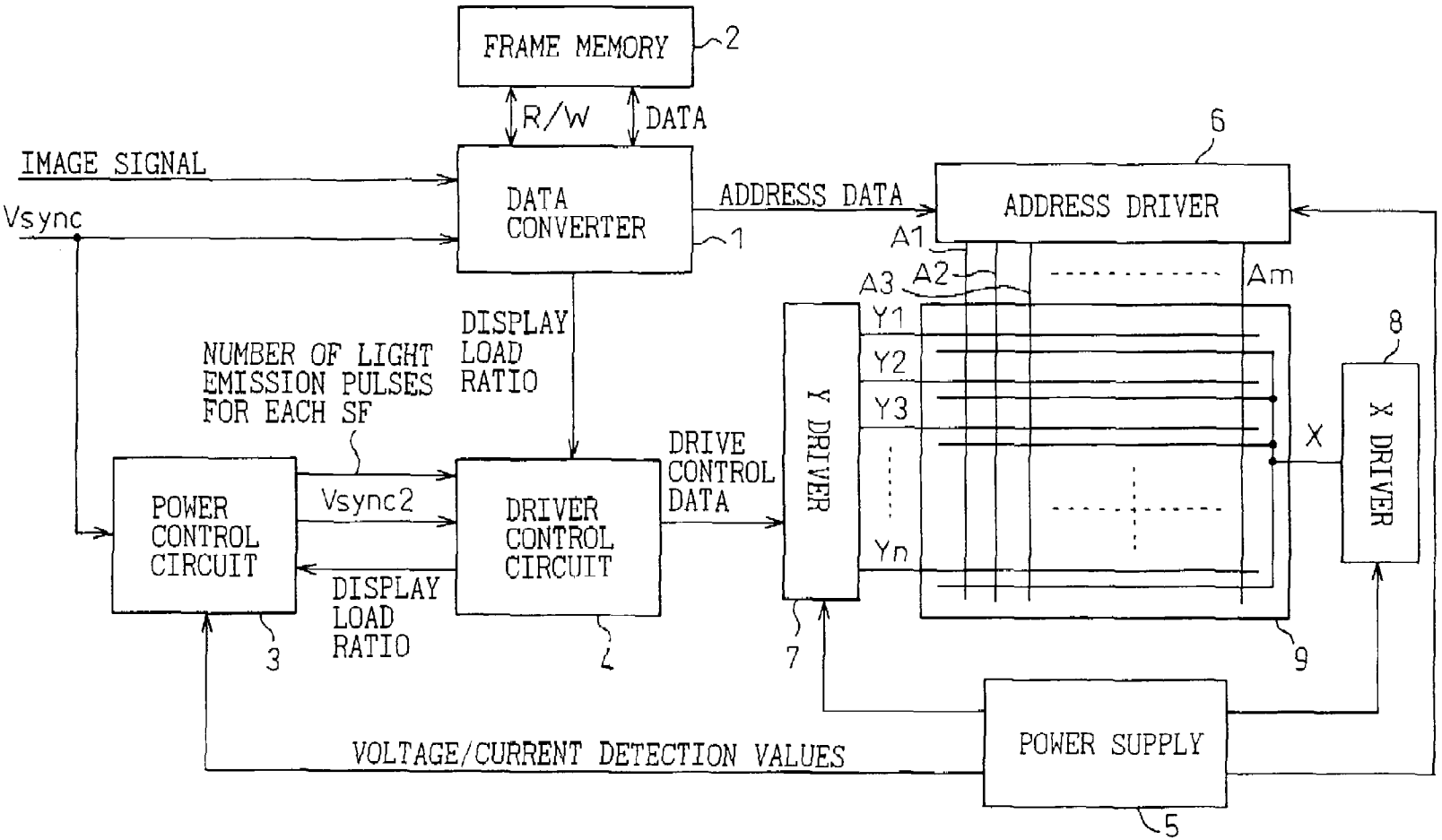
FIG. 1 is a block diagram showing one example of a display apparatus to which the present invention is applied.

FIG. 1 is a block diagram showing one example of a display apparatus to which the present invention is applied; here, one example of a plasma display apparatus (plasma display panel: PDP) is illustrated. In FIG. 1, reference numeral 1 is a data converter, 2 is a frame memory, 3 is a power control circuit, 4 is a driver control circuit, 5 is a power supply, 6 is an address driver, 7 is a Y driver, 8 is an X driver, and 9 is a display panel.

As shown in FIG. 1, the data converter 1 receives an image signal and a vertical synchronization signal Vsync from the outside, and converts them into PDP display data (data for displaying an image using a plurality of light emission blocks (subfields SFS)). The frame memory 2 holds the PDP display data converted by the data converter 1 and to be used in the next field. The data converter 1 then reads the data previously held in the frame memory 2 and supplies it as address data to the address driver 6, while at the same time, providing its display load ratio to the driver control circuit 4. Here, the display load ratio is found by counting the number of cells to be excited (dots to be illuminated) in each light emission block.

The driver control circuit 4 receives from the power control circuit 3 a control signal for controlling the number of light emission pulses (sustain pulses) for each light emission block (SF) and an internally generated vertical synchronization signal Vsync2, and supplies drive control data to the Y driver 7. The data signal of the display load ratio, output from the data converter 1, is supplied to the power control circuit 3 via the driver control circuit 4.

The display panel 9 includes address electrodes A1 to Am, Y electrodes Y1 to Yn, and X electrodes X, which are driven by the address driver 6, the Y driver 7, and the X driver 8, respectively. The power supply 5, while supplying power to the address driver 6, Y driver 7, and X driver 8, detects voltages and currents from the address driver 6, Y driver 7, and X driver 8 and supplies the detected values to the power control circuit 3. That is, the address voltage and current from the address driver 6 and the sustain voltage and current from the Y driver 7 and X driver 8 are detected, and the detected values are supplied from the power supply 5 to the power control circuit 3 for processing therein. The address driver 6, the Y driver 7, the X driver 8, and the display panel 9 together constitute the display panel section.

Figure 2:
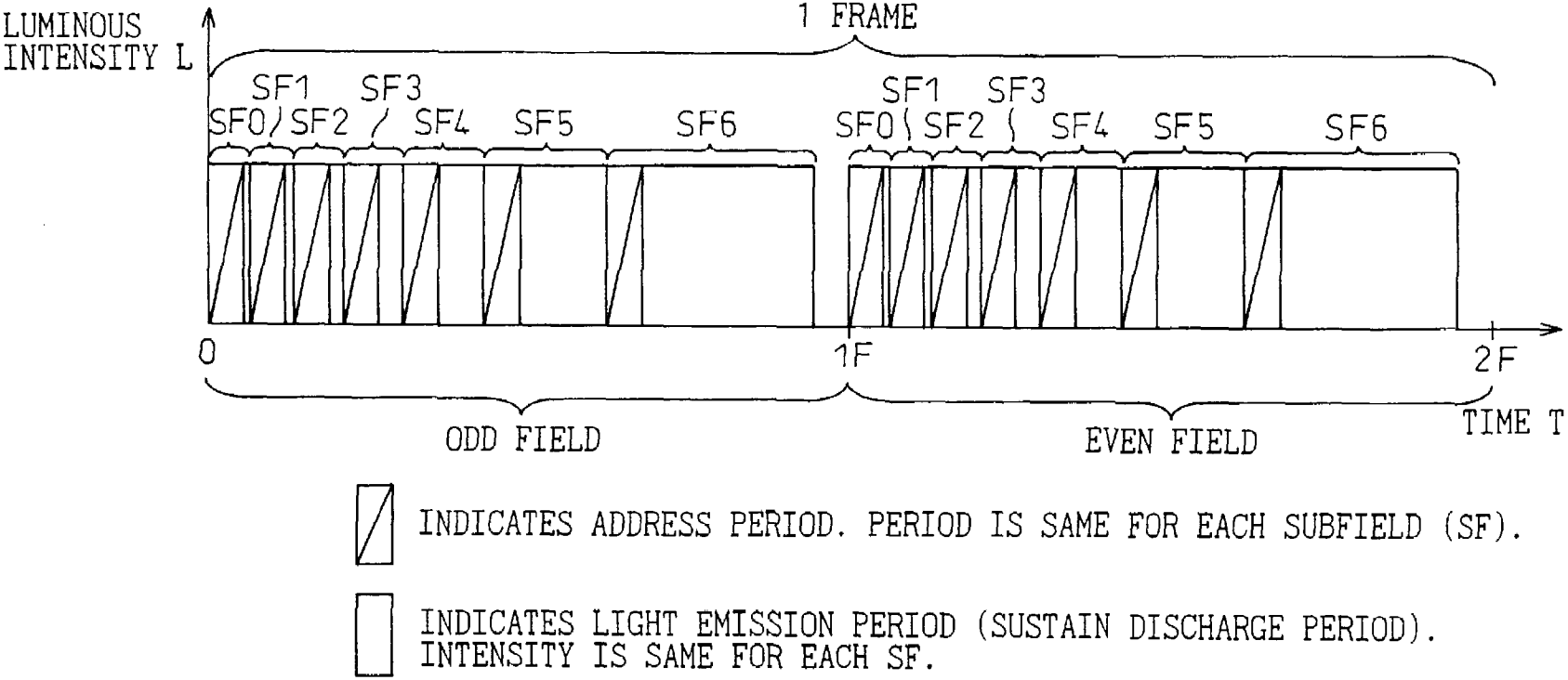
FIG. 2 is a diagram for explaining one example of a driving method for the display apparatus shown in FIG. 1.

FIG. 2 is a diagram for explaining one example of a driving method for the display apparatus shown in FIG. 1.

The driving method shown in FIG. 2 displays one image frame by interlacing two fields, an odd field and an even field, and the odd field and the even field are each made up of a plurality of light emission blocks (subfields, for example, seven subfields SF0 to SF6). Each of the light emission blocks SF0 to SF6 has an address period, during which address discharge is performed to excite cells in accordance with the address data, and a light emission period (sustain discharge period), during which light emission pulses (sustain pulses) are applied to the selected cells (illuminated cells) to sustain the light emission state.

FIG. 3 is a diagram showing how the total number of light emission pulses is divided in accordance with a weight ratio among the subfields.

As shown in FIG. 3, the total number of light emission pulses, which is determined by the display load ratio, is divided in accordance with the weight ratio among the subfields. More specifically, when the total number of light emission pulses is 508, for example, the number of light emission pulses assigned in accordance with the weight ratio among the subfields SF0 to SF6 is 4 for SF0, 8 for SF1, 16 for SF2, 32 for SF3, 64 for SF4, 128 for SF5, and 256 for SF6.

FIGS. 4A and 4B are diagrams for explaining the problem associated with the prior art display apparatus driving method: FIG. 4A shows the relationship between brightness and the number of light emission pulses, and FIG. 4B shows the relationship between output brightness and input grayscale.

As shown in FIG. 4A, the relationship between the brightness and the number of light emission pulses is not linear because of the brightness saturation of phosphors, and there occurs (as shown in FIG. 4B) a brightness step because the brightness of each subfield (SF) falls short of expected brightness, or a brightness step because discharge spreads into non-illuminated pixels due to overlay or other processing.

That is, grayscale continuity cannot be secured by just dividing the total number of light emission pulses in accordance with the subfield weight ratio. One possible solution to this problem is to increase the number of light emission pulses in each subfield by considering the brightness saturation or to decrease the number of light emission pulses by considering the increase of brightness due to discharge spreading.

However, by just adjusting the number of light emission pulses in each subfield as described above, grayscale continuity cannot be secured in a reliable manner. This is because there occurs a brightness step depending on the combination of the light emission subfields, even though the brightness of each subfield itself is exactly as defined by its weight ratio.

To address this brightness step, it has been proposed in the prior art to hold a grayscale continuity compensating light-emission SF (subfield) pattern in the form of a table (in a memory) and to correct the step by choosing an appropriate combination of the light emission subfields. According to the related art, there has also been proposed a method that corrects the brightness step by computation without using such a light-emission SF pattern table.

Figure 5:
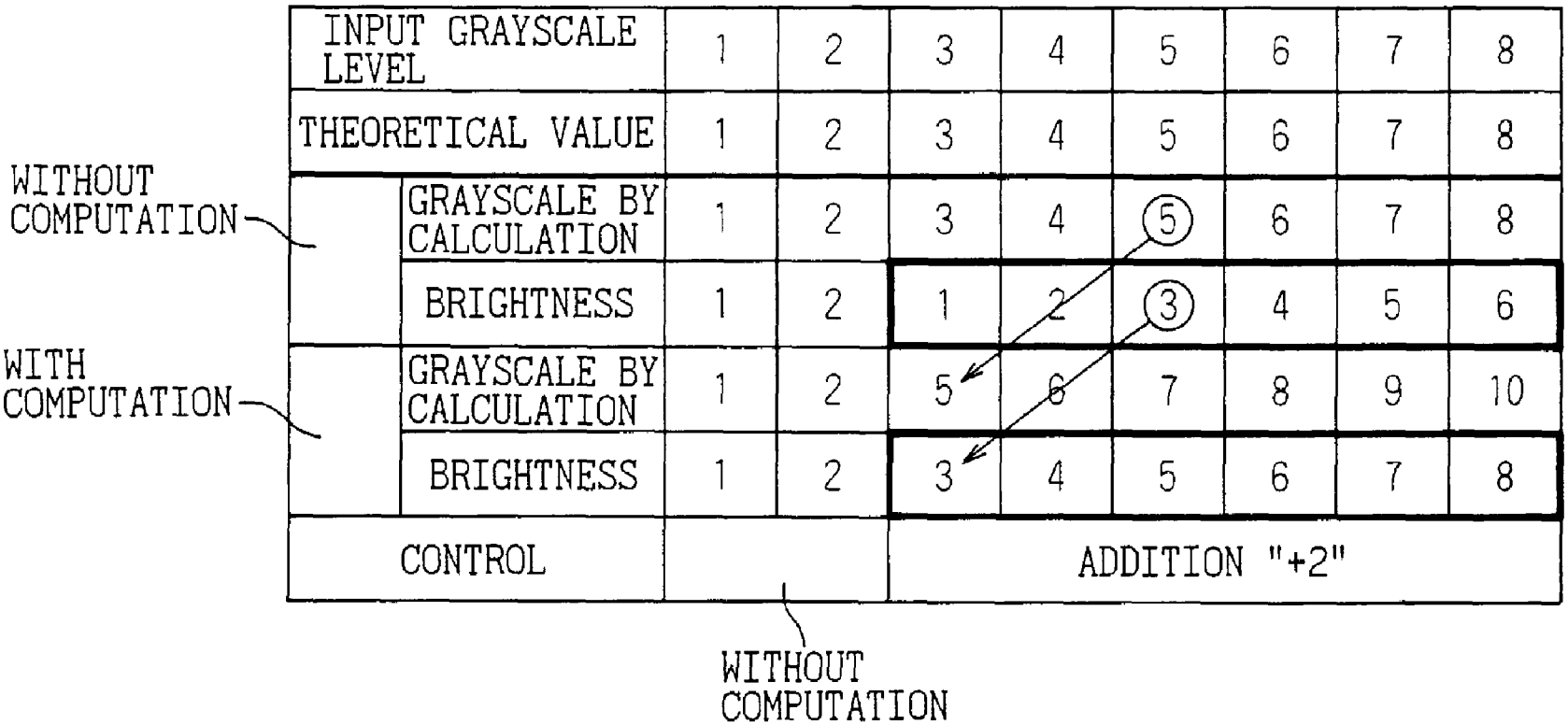
FIG. 5 is a diagram for explaining one example of a display apparatus driving method according to the related art.
Figure 6:
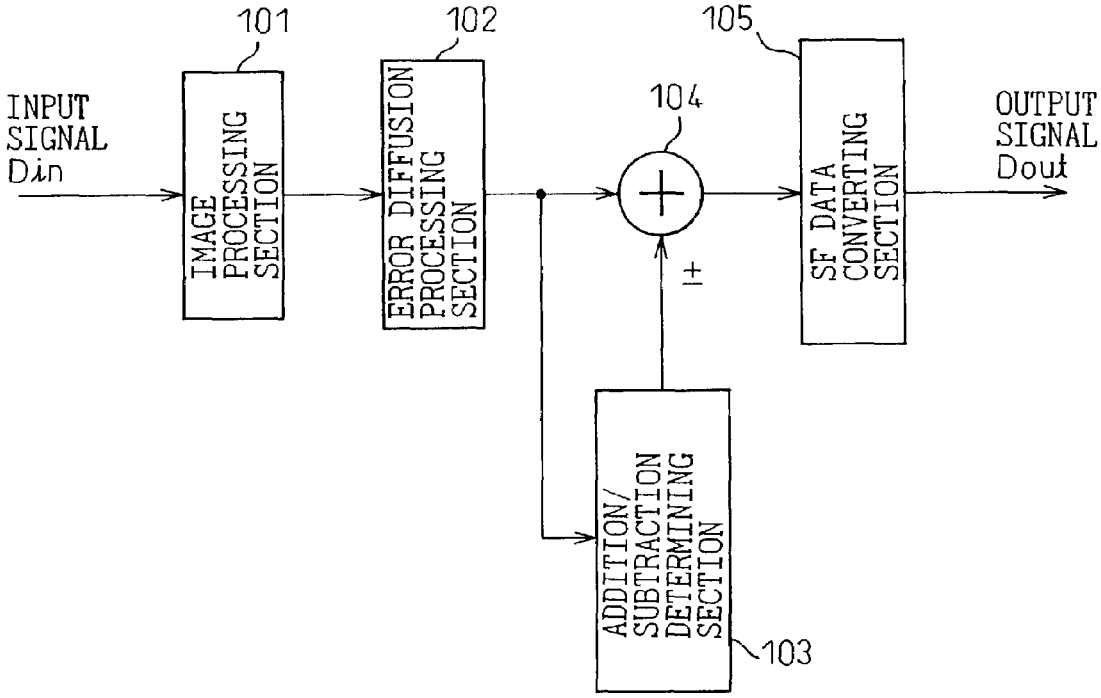
FIG. 6 is a block diagram showing one configuration example for implementing the driving method of FIG. 5.

FIG. 5 is a diagram for explaining one example of the display apparatus driving method according to the related art, and FIG. 6 is a block diagram showing one configuration example for implementing the driving method of FIG. 5. In FIG. 6, reference numeral 101 is an image processing section, 102 is an error diffusion processing section, 103 is an addition/subtraction determining section, 104 is an addition/subtraction operation section, and 105 is a subfield (SF) data converting section.

In the driving method shown in FIG. 5, and in, for example, the case where when the input grayscale level is 3, the theoretical value of brightness is also 3, but the actual brightness corresponding to the grayscale level 3 obtained by calculation is 1; in such a case, operations are performed to make the grayscale level that is 5 by calculation, and at which the actual brightness is the same as the theoretical value of 3, correspond to the input grayscale level 3.

As shown in FIG. 6, an input signal Din input into the image processing section 101 is supplied directly to the error diffusion processing section 102, and a value output from the addition/subtraction determining section 103 is added to (or subtracted from) the error-diffused image signal in the addition/subtraction operation section 104. More specifically, in the case shown in FIG. 5, since there is a brightness step of −2 with respect to the theoretical value of brightness for the input grayscale level 3 (the input grayscale levels 3 and larger), the addition/subtraction determining section 103, which receives the output of the error diffusion processing section 102 and determines whether the operation to be performed is an addition or subtraction, supplies a correction value "+2" for the input grayscale level 3 to the addition/subtraction operation section 104, as a result of which a signal with +2 added to the output of the error diffusion processing section 102 is fed to the SF data converting section 105.

That is, for the input grayscale levels 3 and larger, the SF data converting section 105 outputs the grayscale level obtained by adding "+2" to the input grayscale level as an output signal Dout, thus eliminating the brightness step and producing a display retaining grayscale continuity. FIGS. 5 and 6 have been described for the case in which only one brightness step has occurred due to the combination of the light emission subfields, but in actuality, such brightness steps occur at a plurality of locations (for example, at about six locations), and the above addition (or subtraction) operation is performed for each brightness step portion.

On the other hand, the prior art display apparatus driving method that uses a grayscale continuity compensating light-emission SF pattern table, as earlier described, requires a large capacity memory (table) to store an enormous amount of table covering every possible combination of the subfields.

FIG. 7 is a diagram for explaining the problem associated with the display apparatus driving method according to the related art.

As shown in FIG. 7, according to the related art described with reference to FIGS. 5 and 6, when the (addition) operation is performed, the brightness corresponding to the input grayscale level 3 is set, for example, to "14", in which case the brightness step with respect to the brightness "8" for the input grayscale level 2 is "6". Here, the smallest unit of subfield weight is "4".

In this case, since, in the related art, the brightness can be controlled only in steps of "4" defined as the smallest unit of subfield weight, if the operation to add "+2" to the grayscale level is performed, for example, for the brightness corresponding to the input grayscale level 3, the brightness step cannot be completely eliminated.

That is, the display apparatus driving method using the related art computation process has the problem that, as the addition/subtraction operation is performed immediately before determining the light emission subfields, control can only be performed in steps equivalent to the smallest unit of subfield weight, and further, when the total number of light emission pulses is varied by power control, the ratio of the number of light emission pulses set for each subfield is displaced from the theoretical value, resulting in a loss of continuity.

Embodiments of the display apparatus and its driving method according to the present invention will be described in detail below with reference to drawings. Here, it will be recognized that the display apparatus and its driving method according to the present invention are not limited in application to interlaced scan PDPs, but can be applied widely to various other display apparatuses.

The present invention performs the grayscale continuity compensating process, not by using a table (memory), but by computation, thereby preventing an increase in program amount. The invention also makes it possible to perform the addition/subtraction computation process not only on integers but also on numbers containing decimal fractions, by placing the computation process in front of the error diffusion process. Further, when the total number of light emission pulses is reduced by power control, the ratio of the number of light emission pulses among the subfields is disrupted, but in the present invention, grayscale continuity is retained by compensating for the resulting brightness step by performing the addition/subtraction operation; to achieve this, computation coefficients are varied according to the display load ratio or the total number of light emission pulses.

In this specification, the term "field" is used by assuming the case of interlaced scanning in which one image frame is made up of two fields, an odd field and an even field, but in the case of progressive scanning in which one image frame is made up of one field, the term "field" can be used interchangeably with "frame".

Figure 8:
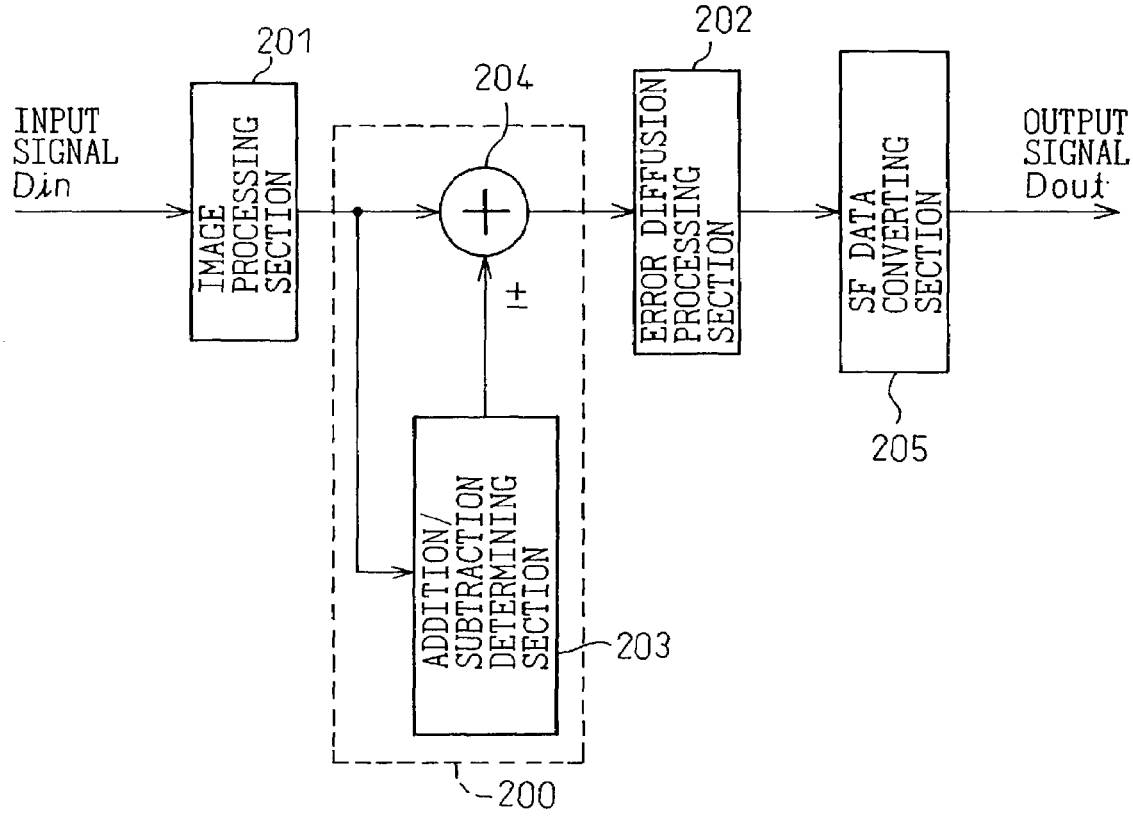
FIG. 8 is a block diagram showing one configuration example for implementing the display apparatus driving method according to the present invention.

FIG. 8 is a block diagram showing one configuration example for implementing the display apparatus driving method according to the present invention. In FIG. 8, reference numeral 201 is an image processing section, 202 is an error diffusion processing section, 203 is an addition/subtraction determining section, 204 is an addition/subtraction operation section, and 205 is a subfield (SF: light emission block) data converting section. Here, the addition/subtraction determining section 203 and the addition/subtraction operation section 204 together constitute a grayscale continuity compensating circuit 200.

As is apparent from a comparison between FIG. 8 and the earlier described FIG. 6, in the configuration shown in FIG. 8 the addition/subtraction determining section 203 and the addition/subtraction operation section 204 are placed in front of the error diffusion processing section 202.

As shown in FIG. 8, the input signal Din is supplied via the image processing section 201 to the addition/subtraction determining section 203 and the addition/subtraction operation section 204, and the output value of the addition/subtraction determining section 203 is added (or subtracted) in the addition/subtraction operation section 204. Then, the output of the addition/subtraction operation section 204 is fed to the error diffusion processing section 202 where error diffusion is applied to the signal resulting from the (addition/subtraction) operation, and the signal with the error diffusion applied thereto is supplied to the SF data converting section 205.

Figure 9:
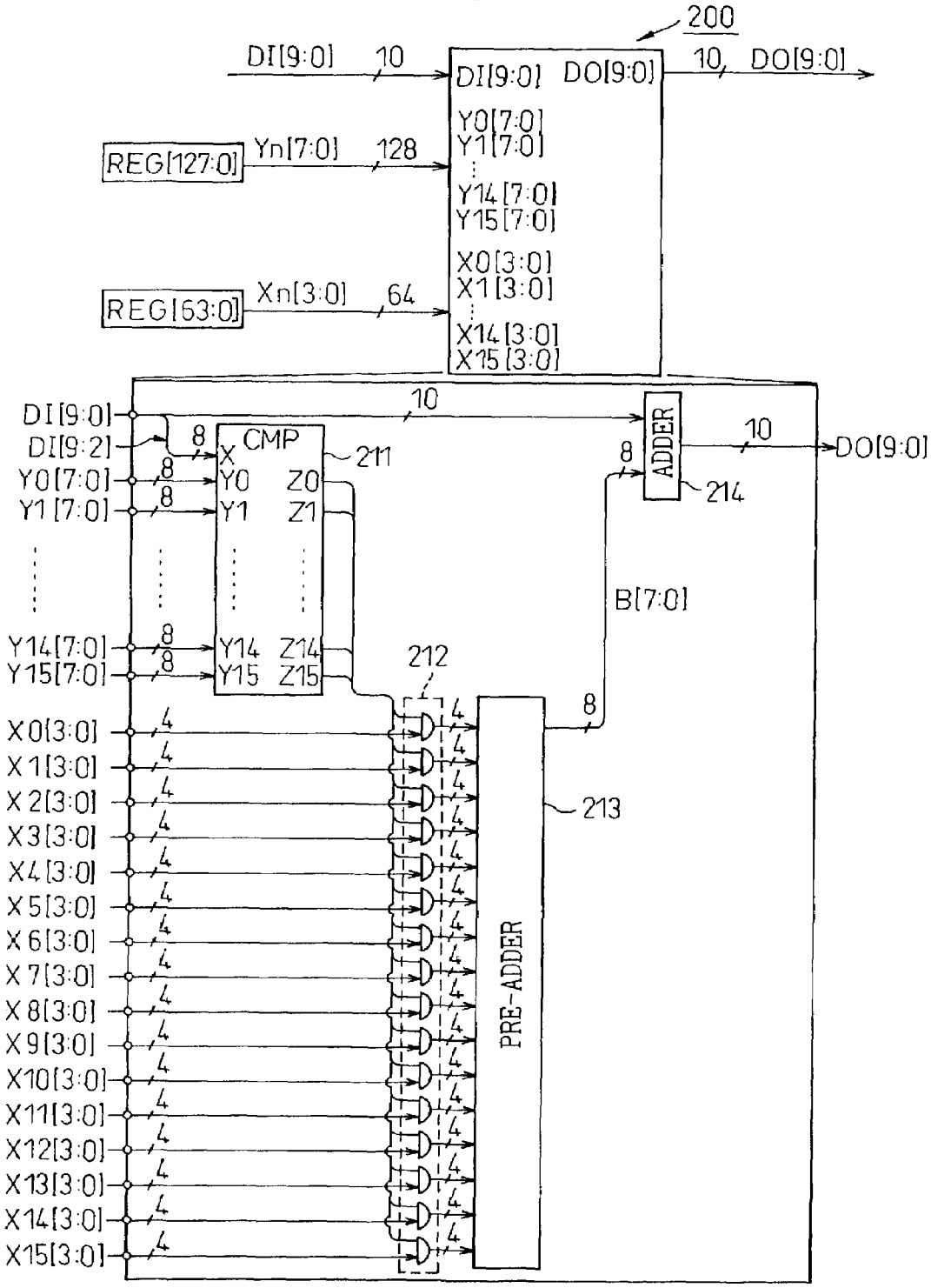
FIG. 9 is a block circuit diagram showing one example of a grayscale continuity compensating circuit in the display apparatus according to the present invention.

FIG. 9 is a block circuit diagram showing one example of the grayscale continuity compensating circuit in the display apparatus according to the present invention. The grayscale continuity compensating circuit 200 shown here corresponds to the addition/subtraction determining section 203 and addition/subtraction operation section 204 shown in FIG. 8.

As shown in FIG. 9, the grayscale continuity compensating circuit 200 comprises a comparator 211, an AND gate array 212, a pre-adder 213, and an adder 214. The comparator 211 compares the high-order 8 bits (DI[9:2]) of the 10-bit input data DI [9:0] with each of 8-bit correction coefficient appending positions Yn[7:0] (Y0[7:0] to Y15[7:0], see FIG. 12), and supplies the results (outputs Z0 to Z15) to the AND gate array 212. Here, it will be appreciated that the number of correction coefficient appending positions Yn[7:0] is not limited to 16 (Y0 to Y15), but that the number can be varied in various ways according to the configuration of light emission blocks, etc.

The AND gate array 212 comprises a plurality of AND gates which AND the respective outputs (Z0 to Z15) of the comparator 211 with respective 4-bit correction coefficients Xn[3:0] (X0[3:0] to X15[3:0]), and the 4-bit outputs of the respective AND gates are added in the pre-adder 213, and the resulting 8-bit output is supplied to the adder 214. The adder 214 adds the output of the pre-adder 203 to the input data DI[9:0], and produces a 10-bit output DO[9:0].

Figure 10:
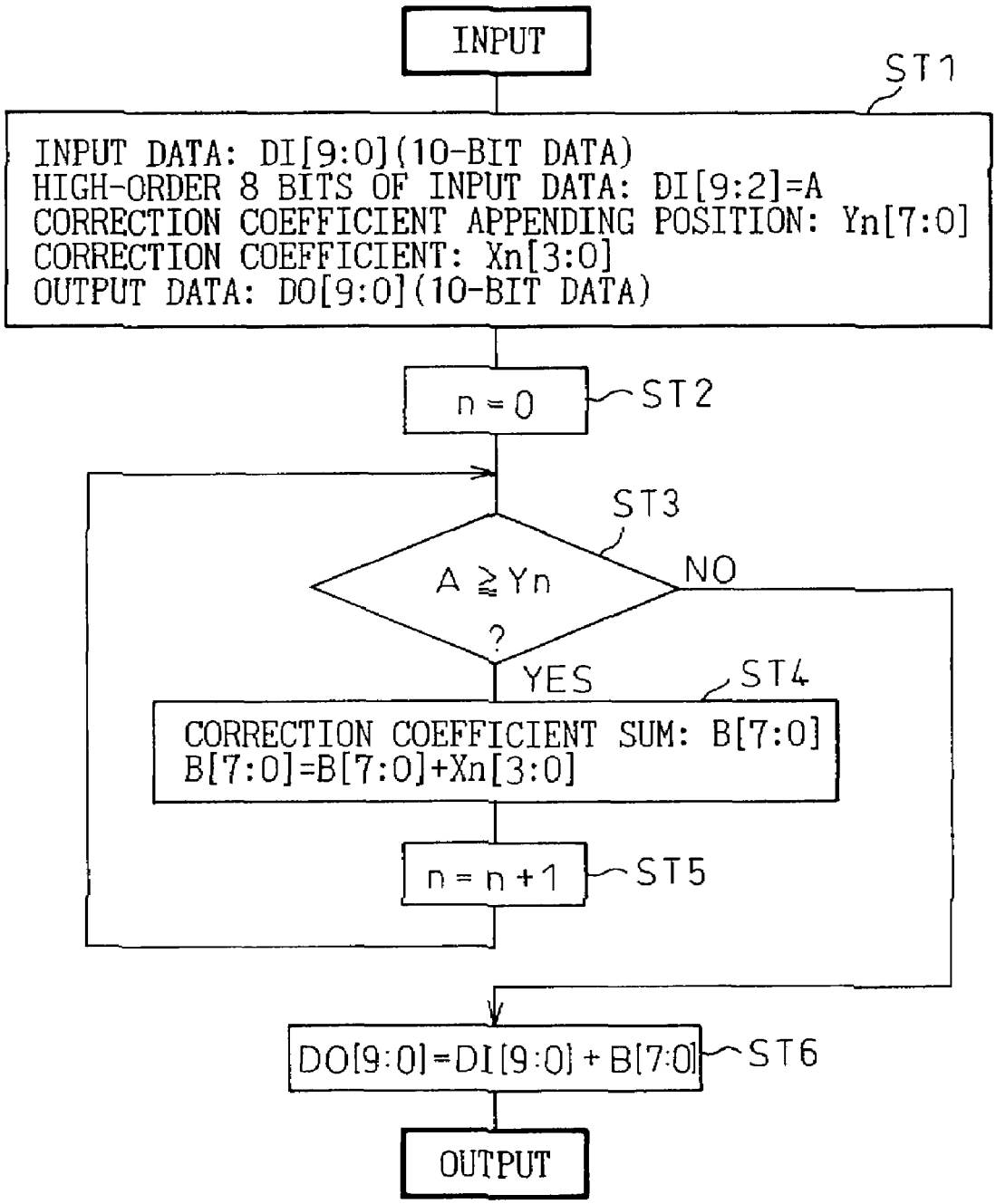
FIG. 10 is a flowchart for explaining one example of the operation of the grayscale continuity compensating circuit shown in FIG. 9.
Figure 12:
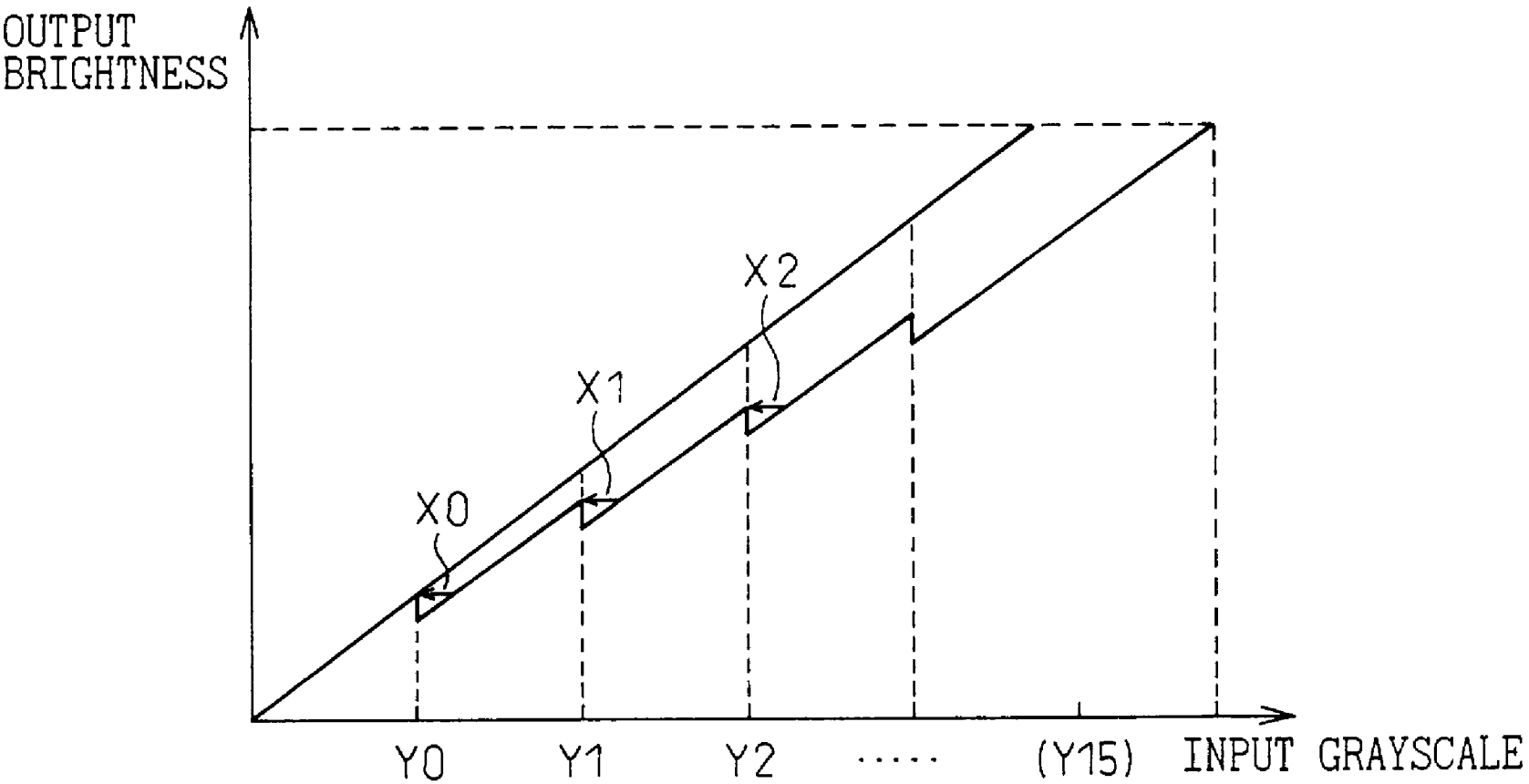
FIG. 12 is a diagram showing the relationship between output brightness and input grayscale for explaining one example of the operation of the grayscale continuity compensating circuit shown in FIG. 9.

FIG. 10 is a flowchart for explaining one example of the operation of the grayscale continuity compensating circuit shown in FIG. 9, FIG. 11 is a diagram for explaining one example of the operation of the grayscale continuity compensating circuit shown in FIG. 9, and FIG. 12 is a diagram showing the relationship between output brightness and input grayscale for explaining one example of the operation of the grayscale continuity compensating circuit shown in FIG. 9.

First, when the input data Din is input into the grayscale continuity compensating circuit 200 (addition/subtraction determining section 203) via the image processing section 201, in step ST1 the high-order 8 bit part (DI[9:2]) of the input data Din (10-bit input data DI[9:0]) is set as A (DI[9:2]=A), the correction coefficient appending position as Yn[7:0], and the correction coefficient as Xn[3:0]. Further, the output data (10-bit output data) of the grayscale continuity compensating circuit 200 (addition/subtraction operation section 204) is set as DO[9:0]. Next, the process proceeds to step ST2 where n is set to 0, and then the process proceeds to step ST3 where A is compared with Yn (in the comparator 211 shown in FIG. 9).

If it is determined in step ST3 that the relation A≧Yn holds, the process proceeds to step ST4 where the correction coefficient is added to a correction coefficient sum B[7:0] (B[7:0]=B[7:0]+Xn[3:0]). The process then proceeds to step ST5 to increment n by 1 (n=n+1), and returns to step ST3 to repeat the same process until it is determined that A≧Yn no longer holds (A<Yn holds). That is, corrections are applied for all the correction coefficient appending positions Yn (for example, 16 correction coefficient appending positions Y0 to Y15 are corrected using the correction coefficients Xn (X0 to X15), see FIG. 12).

When it is determined in step ST3 that A≧Yn no longer holds, the process proceeds to step ST6 where the correction coefficient sum B [7:0] (the output of the pre-adder 213 in FIG. 9) is added to the input data DI[9:0] to compute the output data DO[9:0] (in the adder 214 shown in FIG. 9).

In this way, the operation such as shown in FIG. 11 (for compensating for every brightness step in the input data DI[9:0]) is performed, and the output data DO[9:0] is produced. The output data of the grayscale continuity compensating circuit 200 (addition/subtraction operation section 204) is supplied to the error diffusion processing section 202 at the next stage for error diffusion.

FIG. 13 is a diagram for explaining a first embodiment of the display apparatus driving method according to the present invention.

As is apparent from a comparison between FIG. 13 and the previously described FIG. 7, and as, in the first embodiment, the addition/subtraction determining section 203 and addition/subtraction operation section 204 (grayscale continuity compensating circuit 200) which perform the operation profess are placed in front of the error diffusion processing section 202, it becomes possible, for example, to add "+1.5" to the grayscale level for the brightness corresponding to the input grayscale level 3. That is, by performing the operation (addition operation), the brightness for the input grayscale level 3 can be set to "12", providing a grayscale step of "4" with respect to the brightness "8" for the input grayscale level 2; as a result, the brightness step can be completely eliminated. Here, the error diffusion by the error diffusion processing section 202 is applied to the output of the addition/subtraction operation section 204 compensated for the above brightness step.

FIG. 14 is a diagram for explaining a second embodiment of the display apparatus driving method according to the present invention.

First, it is assumed that when the number of light emission pulses (sustain pulses: SUSs) is distributed over the respective subfields, the ideal numbers of light pulses for the respective subfields are as shown in Item 1 in FIG. 14. That is, when distributing a total of 254 light emission pulses over the subfields SF0 to SF6, the ideal numbers of light emission pulses are 2, 4, 8, 16, 32, 64, and 128 for the subfields SF0, SF1, SF2, SF3, SF4, SF5, and SF6, respectively.

Suppose here that the total number of light emission pulses is reduced by power control, for example, to 200 as shown in Item 2 in FIG. 14; in this case, the numbers of light emission pulses are 2, 3, 6, 13, 25, 50, and 101 for the subfields SF0, SF1, SF2, SF3, SF4, SF5, and SF6, respectively. This causes displacements from the above ideal brightness values, disrupting the brightness ratio among the subfields. Such brightness ratio displacements would have a significant effect if they occur, among others, in subfields having small weights (for example, SF0, SF1, and SF2); accordingly, in the second embodiment, the numbers of light emission pulses for such subfields are fixed as shown in Item 3 in FIG. 14. That is, in the second embodiment, the brightness ratio among the subfields having small weights (SF0 to SF2) is fixed, and power control is performed by reducing the numbers of light emission pulses for the subfields having large weights (SF3 to SF6). The brightness steps that occur when exciting such heavily weighted subfields with reduced numbers of light emission pulses are compensated for by performing the earlier described operations in the addition/subtraction determining section 203 and addition/subtraction operation section 204 provided in front of the error diffusion processing section 202.

FIG. 15 is a diagram for explaining a third embodiment of the display apparatus driving method according to the present invention.

First, it is assumed that the ideal numbers of light emission pulses in the respective subfields for the respective total numbers of light emission pulses are as shown in Items 1 to 4 in FIG. 15. That is, when the total number of light emission pulses is 127, for example, the ideal numbers of light emission pulses are 1, 2, 4, 8, 16, 32, and 64 (ideal value 1 in Item 1 in FIG. 15) for the subfields SF0, SF1, SF2, SF3, SF4, SF5, and SF6, respectively; when the total number of light emission pulses is 254, the ideal numbers are 2, 4, 8, 16, 32, 64, and 128, respectively (ideal value 2 in Item 2 in FIG. 15); when the total number of light emission pulses is 381, the ideal numbers are 3, 6, 12, 24, 48, 96, and 192, respectively (ideal value 3 in Item 3 in FIG. 15); and when the total number of light emission pulses is 508, the ideal numbers are 4, 8, 16, 32, 64, 128, and 256, respectively (ideal value 4 in Item 4 in FIG. 15).

In this way, in the third embodiment, the subfield (SF0) having the smallest weight is taken as a reference and, based on its brightness, the numbers of light emission pulses in the respective subfields (SF0 to SF6) are determined to achieve the ideal brightness ratio (ideal values 1 to 4). Here, as for switching among ideal values 1 to 4, the ideal value for the total number of light emission pulses that is larger than and closest to the total number of light emission pulses determined by power control, for example, is taken as a reference, based on which the numbers of light emission pulses are fixed and increased or decreased, respectively. In a specific example, if the total number of light emission pulses determined by power control is 350, then the ideal numbers of light emission pulses for the respective fields shown in Item 3 in FIG. 15 (ideal value 3) are taken as the reference.

Alternatively, switching among ideal values 1 to 4 may be made, for example, by reference to the ideal value for the total number of light emission pulses that is closest to the total number of light emission pulses determined by power control and, based on this reference, the numbers of light emission pulses may be fixed and increased or decreased, respectively. Here, for example, when the total number of light emission pulses determined by power control is larger than the ideal value for the total number of light emission pulses taken as the reference, control may be performed, for example, by increasing the numbers of light emission pulses for the subfields having large weights (SF3 to SF6) while holding fixed the brightness ratio among the subfields having small weights (SF0 to SF2). In this example, if the total number of light emission pulses determined by power control is 300, then the ideal numbers of light emission pulses for the respective fields shown in Item 2 in FIG. 15 (ideal value 2) are taken as the reference.

Figure 16:
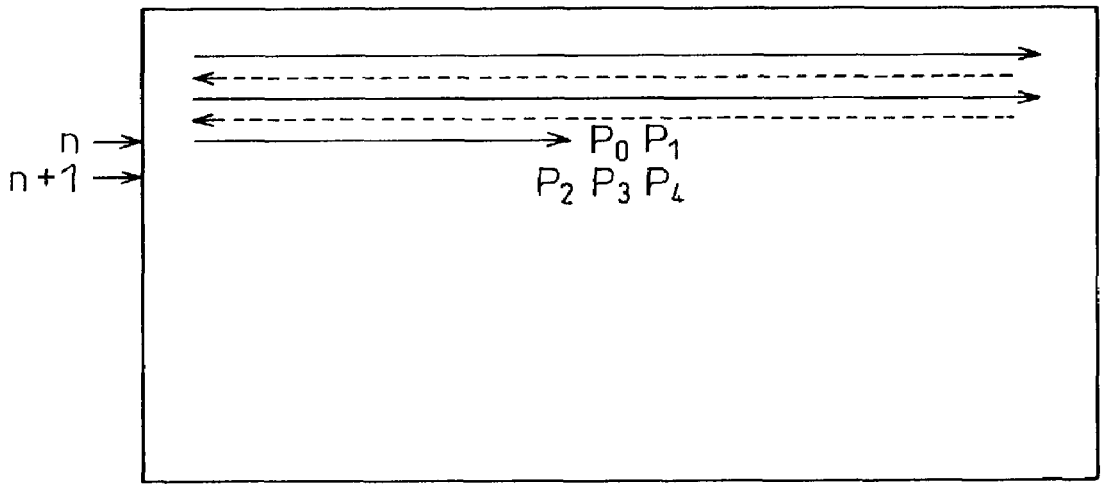
FIG. 16 is a diagram for explaining an error diffusion process applied to the present invention.
Figure 17:
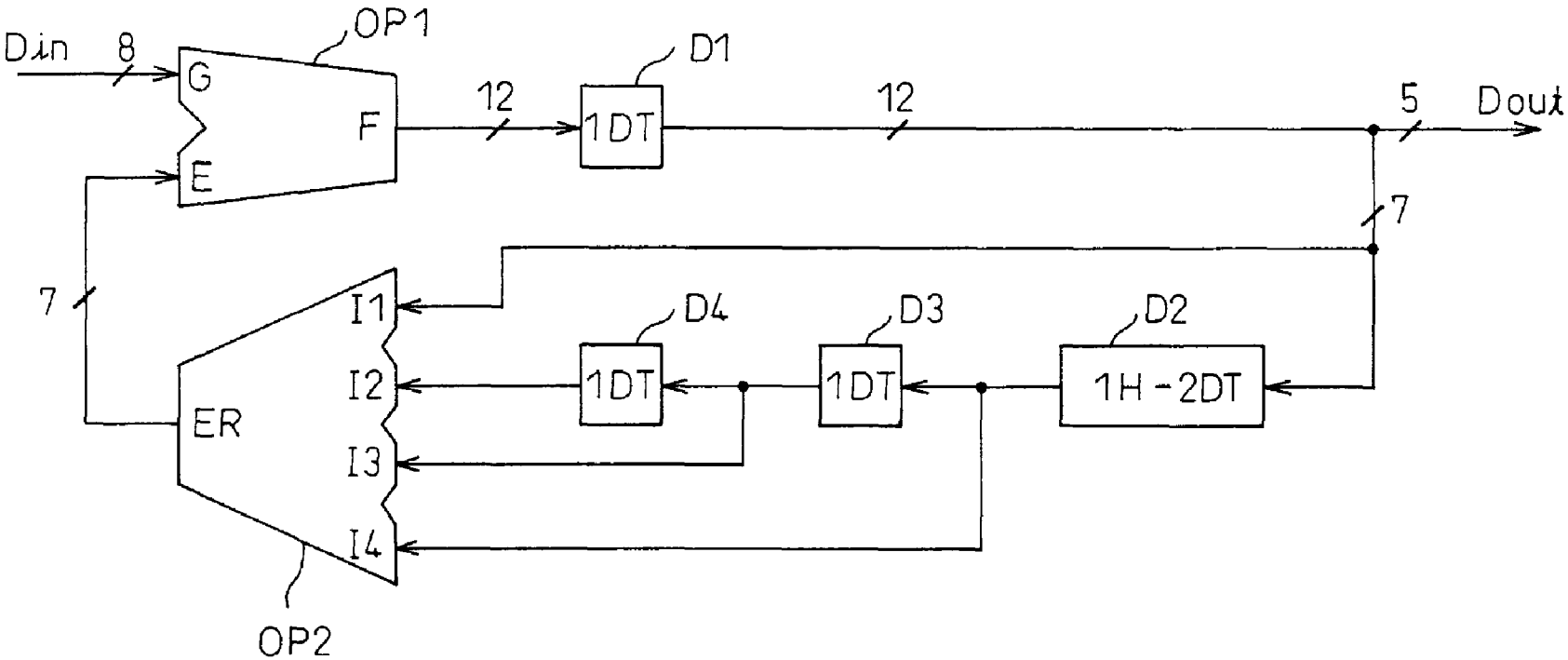
FIG. 17 is a circuit diagram showing one example for implementing the error diffusion process shown in FIG. 16.

FIG. 16 is a diagram for explaining the error diffusion process applied to the present invention, and FIG. 17 is a circuit diagram showing one example for implementing the error diffusion process shown in FIG. 16.

The error diffusion process used in each of the above-described embodiments, that is, the error diffusion process performed in the error diffusion processing section 202 in FIG. 8, can make use of prior known techniques, an example of which is described below.

First, as shown in FIG. 16, when causing all the pixels in an image display to display respectively designated halftone image data, attention is paid to a particular pixel portion $P_0$, and also to the line n to which this particular pixel portion $P_0$ belongs and the line n+1 to be scanned next. Then, error data is distributed in prescribed proportions over a total of four pixel portions, i.e., the pixel portion $P_1$ adjacent to the right of the particular pixel portion $P_0$ in the scanning direction and the pixel portions $P_2$, $P_3$, and $P_4$ located on the line n+1 at positions lower left, below, and lower right with respect to $P_0$. Here, a prior known configuration can be employed for the error diffusion processing operation circuit used to accomplish the above error diffusion process; one example of the circuit is shown in FIG. 17.

That is, as shown in FIG. 17, when halftone image data $D_{IN}$ (13 to 0) is input to an operation means OP1, and the output of the operation means OP1 is passed through a first delay means D1 and delivered as an output $D_{OUT}$ (7 to 0), for example, the output is also supplied through a second delay means D2 to an I4 terminal on an operation means OP2, thereby generating the error data to be distributed to the pixel portion $P_4$. The output the operation means OP1 passed through the first delay means D1 is also supplied directly to an I1 terminal on the operation means OP2, thereby generating the error data to be distributed to the pixel portion $P_1$. Here, the first delay means D1 has a delay function (1DT) equivalent to one dot, while the second delay means D2 has a delay function (1H-2DT) equivalent to one line or two dots.

Further, the output of the second delay means D2 is supplied through a third delay means D3 to an I3 terminal on the operation means OP2, thereby generating the error data to be distributed to the pixel portion $P_3$, and the output of the third delay means D3 is supplied through a fourth delay means D4 to an I2 terminal on the operation means OP2, thereby generating the error data to be distributed to the pixel portion $P_2$. Here, the third delay means D3 has a delay function (1DT) equivalent to one dot, and the fourth delay means D4 also has a delay function (1DT) equivalent to one dot.

The above error diffusion method is well known in the art; that is, in FIG. 16, the error at a particular dot $P_0$ is diffused over its neighboring dots $P_1$, $P_2$, $P_3$, and $P_4$, distributing its value as $P_1=(7/16)\times P_0$, $P_2=(1/16)\times P_0$, $P_3=(5/16)\times P_0$, and $P_4=(3/16)\times P_0$. In this way, error is diffused by processing the dots from left to right in sequence from top to bottom, to achieve multiple grayscale levels.

Further, in the error diffusion processing operation circuit shown in FIG. 17, the low-order bit and some lower order bits of the data input are processed, the signals to be supplied to the inputs I1 to I4 of the operation means OP2 are aligned in phase by using the dot or line delay elements D1 to D4, the error diffusion such as described above is performed by the operation means OP2, and when the error is accumulated until the output data resume bit rises, a value higher by one grayscale level is output. Since the remaining error is fed back to the operation means OP1, there always remains an error in each field, and the number of grayscale levels can thus be increased. It will be appreciated that the error diffusion process applied to the present invention is not limited to the above particular example.

As described in detail above, according to the present invention, it becomes possible to provide a display apparatus capable of performing power control while retaining grayscale continuity and a method for driving the same.

Many different embodiments of the present invention may be constructed without departing from the spirit and scope of the present invention, and it should be understood that the present invention is not limited to the specific embodiments described in this specification, except as defined in the appended claims.

What is claimed is:

1. A display apparatus comprising:

a display panel section;

a data converter which receives an image signal and supplies image data suitable for said display apparatus to said display panel section, while at the same time, outputting a display load ratio by computing the same from said image signal;

a power supply section which supplies power to said display panel section and, at the same time, outputs information concerning the power being consumed by said display panel section; and a number-of-light-emission-pulses control circuit which receives said display load ratio and said power consumption information and, when adjusting the number of light emission pulses to control the power, determines the number of light emission pulses for each of said plurality of light emission blocks while holding unchanged the number of light emission pulses for each light emission block that has a relatively small number of light emission pulses.

2. The display apparatus as claimed in claim 1, wherein said number-of-light-emission-pulses control circuit sets a plurality of ideal values for the combination of said light emission blocks by using, as a reference, the brightness of the light emission block having the smallest weight and, from among said plurality of ideal values, selects as a reference the ideal value whose total number of light emission pulses is larger than, and closest to, the total number of light emission pulses determined by power control.

3. The display apparatus as claimed in claim 1, wherein said number-of-light-emission-pulses control circuit sets a plurality of ideal values for the combination of said light emission blocks by using, as a reference, the brightness of the light emission block having the smallest weight and, from among said plurality of ideal values, selects as a reference the ideal value whose total number of light emission pulses is closest to the total number of light emission pulses determined by power control.

4. The display apparatus as claimed in claim 1, further comprising a grayscale continuity compensating circuit which compensates for grayscale continuity by performing a grayscale level addition/subtraction operation by computation in accordance with a display ratio for any discontinuous grayscale of brightness occurring as a result of said adjustment of the number of light emission pulses.

5. The display apparatus as claimed in claim 1, further comprising:

an error diffusion processing section which applies error diffusion to said image signal; and a grayscale continuity compensating circuit which precedes said error diffusion processing section, and which compensates for grayscale continuity by performing a grayscale level addition/subtraction operation in accordance with a display ratio for any discontinuous grayscale of brightness occurring as a result of said adjustment of the number of light emission pulses.

6. A method for driving a display apparatus that has in each field a predetermined plural number of light emission blocks each comprising a plurality of light emission pulses, and that displays grayscale by combining said light emission blocks, comprising:

when adjusting the number of light emission pulses for power control, determining the number of light emission pulses for each of said plurality of light emission blocks while holding unchanged the number of light emission pulses for each light emission block that has a relatively small number of light emission pulses; and for any discontinuous grayscale of brightness occurring as a result of said adjustment of the number of light emission pulses, performing a grayscale level addition/subtraction operation by computation in accordance with a display ratio.

7. A method for driving a display apparatus that has in each field a predetermined plural number of light emission blocks each comprising a plurality of light emission pulses, and that displays grayscale by combining said light emission blocks, comprising:

when adjusting the number of light emission pulses for power control, determining the number of light emission pulses for each of said plurality of light emission blocks while holding unchanged the number of light emission pulses for each light emission block that has a relatively small number of light emission pulses; and for any discontinuous grayscale of brightness occurring as a result of said adjustment of the number of light emission pulses, performing a grayscale level addition/subtraction operation in accordance with a display ratio before applying error diffusion.

8. A method for driving a display apparatus that has in each field a predetermined plural number of light emission blocks, each comprising a plurality of light emission pulses, and that displays grayscale by combining said light emission blocks, comprising:

when adjusting the number of light emission pulses for power control, determining the number of light emission pulses for each of said plurality of light emission blocks while holding unchanged the number of light emission pulses for each light emission block that has a relatively small number of light emission pulses; and setting a plurality of ideal values for the combination of said light emission blocks by using, as a reference, the brightness of the light emission block having the smallest weight and, of said plurality of ideal values, selecting, as a reference, the ideal value whose total number of light emission pulses is larger than and closest to the total number of light emission pulses determined by power control.

9. A method for driving a display apparatus that has in each field a predetermined plural number of light emission blocks, each comprising a plurality of light emission pulses, and that displays grayscale by combining said light emission blocks, comprising:

when adjusting the number of light emission pulses for power control, determining the number of light emission pulses for each of said plurality of light emission blocks while holding unchanged the number of light emission pulses for each light emission block that has a relatively small number of light emission pulses; and setting a plurality of ideal values for the combination of said light emission blocks by using, as a reference, the brightness of the light emission block having the smallest weight and, of said plurality of ideal values, selective, as a reference, the ideal value whose total number of light emission pulses is closest to the total number of light emission pulses determined by power control.

* * * * *